US010081979B1

(12) United States Patent
Buonpane et al.

(10) Patent No.: US 10,081,979 B1
(45) Date of Patent: Sep. 25, 2018

(54) WINDOW PROTECTOR DEVICE AND METHOD FOR MAKING SAME

(71) Applicants: Gerard Buonpane, Ship Bottom, NJ (US); Diane Buonpane, Ship Bottom, NJ (US)

(72) Inventors: Gerard Buonpane, Ship Bottom, NJ (US); Diane Buonpane, Ship Bottom, NJ (US)

( * ) Notice: Subject to any disclaimer, the term of this patent is extended or adjusted under 35 U.S.C. 154(b) by 0 days.

(21) Appl. No.: 15/886,939

(22) Filed: Feb. 2, 2018

(51) Int. Cl.

| | |
|---|---|
| ***E06B 5/12*** | (2006.01) |
| ***E06B 3/50*** | (2006.01) |
| ***E06B 3/44*** | (2006.01) |
| ***E06B 9/24*** | (2006.01) |
| *E06B 9/00* | (2006.01) |

(52) U.S. Cl.
CPC ..... *E06B 3/5063* (2013.01); *E06B 3/4415* (2013.01); *E06B 5/12* (2013.01); *E06B 9/24* (2013.01); *E06B 2003/4476* (2013.01); *E06B 2003/4484* (2013.01); *E06B 2003/4492* (2013.01); *E06B 2009/005* (2013.01)

(58) Field of Classification Search
CPC ..... E06B 9/24; E06B 5/12; E06B 2003/4476; E06B 2003/4492; E06B 2009/005
See application file for complete search history.

(56) References Cited

U.S. PATENT DOCUMENTS 5,392,686 A * 2/1995 Sankar ..... F41H 5/08 109/49.5
6,161,605 A * 12/2000 Pena ..... E06B 9/0638 160/105
6,898,907 B2 * 5/2005 Diamond ..... E06B 9/02 411/521
7,793,581 B2 * 9/2010 Erskine ..... B32B 17/10036 89/36.04
7,802,606 B2 * 9/2010 Landry ..... E06B 5/003 160/62
8,281,841 B2 * 10/2012 Landry ..... E06B 5/003 160/62
8,291,657 B2 * 10/2012 White ..... E06B 5/106 109/49.5
9,752,373 B2 * 9/2017 Pardue ..... E06B 3/30
2007/0193137 A1 * 8/2007 DeBoth ..... E06B 9/02 52/202
2009/0151276 A1 * 6/2009 Debes, Jr. ..... E06B 9/02 52/203
2010/0281783 A1 * 11/2010 Harrington ..... E04H 9/14 52/2.23

FOREIGN PATENT DOCUMENTS

EP 2789784 B1 * 5/2015 ..... E06B 5/12

* cited by examiner

*Primary Examiner* — Adriana Figueroa
(74) *Attorney, Agent, or Firm* — Keene IP Law, LLC

(57) ABSTRACT

A window protector device and method is provided that includes a polycarbonate receptacle configured to be received in an outermost groove of a double-hung tilt-wash window frame, a multi-wall polycarbonate rectangular cuboid panel configured for being received in said receptacle via a two sided adhesive material, the device being coupled to double-hung tilt window sashes via buckled straps disposed in horizontally oriented slotted apertures with the straps sandwiched between the receptacle and the panel, with the ends of the straps extending outwardly from the panel for strapping onto the respective window sashes.

2 Claims, 4 Drawing Sheets

WINDOW PROTECTOR DEVICE AND METHOD FOR MAKING SAME

FIELD OF THE INVENTION

The invention relates generally to window protector devices, and more particularly, to window protector devices that may be used during major weather events, including hurricanes, tornadoes, and other major storms for non-impact and impact-rated double-hung tilt-wash windows.

BACKGROUND OF THE INVENTION

Over the past four decades, there has been an increase in the number of people that have built homes and businesses along the U.S. coastline. Nationally, coastline counties grew an average of 5.6 percent since 2010, while inland counties grew just 4 percent. From 1970 to 2010, the population of these counties increased by almost 40 percent and are projected to increase by an additional 10 million people or 8 percent by 2020. In 2010, 123.3 million people, or 39 percent of our nation's population lived in counties directly on the shoreline and population density in coastal areas will likely continue to increase in the future. With the increase in population density, construction of new homes and/or renovations to existing homes will increase. It is estimated that the U.S. window and door industry, which was valued at $13.5 billion in 2015, will exhibit an annual growth rate of 6 percent from 2016 to 2024. And, the global door and window market reportedly collected revenue of more than $82 billion in 2015 and will continue to grow at an annual rate of 5.6 percent over the period from 2016 to 2024 including both residential and commercial market segments.

The major growth drivers for this market are rapidly increasing new construction and renovation activities in new and developing economies, part of which includes coastal construction. However, not all new construction or renovation in coastal counties mandate the use of impact rated glass in the construction code. This is due to the high cost associated with upgrading to impact resistant windows/doors throughout the dwelling which can easily double the cost of window and door budgets and can slow new growth in developing counties as a result of this financial burden. In addition, upgrading to impact rated glass dramatically increases costs associated with additional structural framing, brackets and fasteners required to support and install the additional weight and thickness of these windows and doors. Therefore, a large unmet need exists for homeowners and business owners who need to protect their dwellings from wind and debris damage that is a less costly and affordable option rather than the current alternative of impact rated glass.

Because windows and doors are the weakest areas on dwellings and most vulnerable to wind damage and penetration, these areas should be protected to minimize the potential of a total loss. Shattered glass in windows and doors can cause a house to become pressurized, like blowing air into a balloon, and can cause the roof to be torn off and lead to the collapse of interior walls and loss of contents. Therefore, covering windows is highly recommended and various types of window coverings currently exist in the market.

Plywood is used by many homeowners as it is the least expensive option but sheets are now recommended to be at least ⅝" thick rather than ½" in order to provide adequate protection in hurricane force winds. However, plywood is heavy, bulky and is awkward to handle and will require at least two people to hang the sheets making it labor intensive and local permits are usually required by the installer. Attaching plywood to a house will require lag bolts, anchors, and the use of power tools and will block light into the dwelling making it difficult to see. In addition, for masonry houses, expansion bolts and galvanized expansion anchors will be needed. These fastening systems will leave permanent holes and marks in the house which may be unsightly and need to be repaired. Also, using plywood may require the use of a lift system to get to second story windows and finding a place for storing the sheets may be a problem.

Storm shutters are popular window protectors. Four common types include storm panels, accordion shutters, Bahama awnings and the roll-down shutter. Installation of any shutter is critical because most failures are caused by loosening of the protective devices due to constant wind pressure and improper fastening to the dwelling.

Storm panels can be used to cover windows and are available in fabric, corrugated polycarbonate, and corrugated aluminum and steel. Fabric storm panels are made from a geosynthetic, PVC coated fabric or Kevlar. They attach around the exterior of windows and doors using grommets and bolts or straps and buckles as an alternative. Although fabric is lightweight, and can be folded for easy storage, it remains expensive.

Corrugated polycarbonate panels are installed in permanently mounted steel tracks bolted to the exterior façade of a home at the top and bottom of the windows and are available in clear, translucent and opaque styles. Corrugated polycarbonate allows light into the home and is relatively lightweight, but requires storage space and assistance when installing exterior panels.

Corrugated aluminum and steel panels are extremely strong. Individual panels typically overlap each other for added strength and are installed in permanently mounted tracks or bolted in place. However, these panels are heavy, require assistance when installing, block light from entering the home and require storage space.

Accordion shutters are permanent home additions that are hinged panels housed in a box bolted to either side of a window and operate via homeowners unfolding them and locking them either in the middle or on the opposite end of the window. They are more expensive than storm panels but are more convenient than panels for homeowners as they can be easily closed and locked into place.

Bahama awnings are permanently fixed louvered awnings that are mounted to the tops of windows and hinged. Homeowners unlatch them from their awning position and secure them below the windows. These awnings cost about the same as accordion shutters.

Roll-down shutters are stored in a box above the window and travel along tracks mounted on either side of the window and bolt down at the bottom. They can be made of high-quality metal or PVC. These shutters can be operated electrically or manually from inside the house and are among the most expensive of the alternatives but are also convenient for the homeowner. Covering a 6 foot window can cost $1,000.00 or more.

Hurricane glass or impact-resistant windows may eliminate the need for shutters or enhance the protection that lower-cost shutters provide. They are typically three times thicker than standard windows and have durably reinforced frames. However, they present an added level of difficulty when it comes to installation. The cost of additional framing, labor and materials needed are much higher when installing these windows due to the additional weight and thickness. Also, the cost doubles when compared to standard windows which can add tens of thousands of dollars to the price depending on the size of a home.

Professional installation of hurricane shutters is an alternative way to ensure that a home is protected according to state and local building codes. Contractors charge by the hour for labor which is dependent on how many shutters are needed as well as the complexity involved in reaching each window. For example, two story homes generally have higher installation costs than single story homes.

Accordingly, there remains a need for window protector devices that protect windows during major storm events, and that are easy to install by the homeowner or building owner.

SUMMARY OF THE INVENTION

According to an aspect of the invention, a window protector device includes a polycarbonate receptacle configured to be received in an outermost groove of a double-hung tilt-wash window frame, including: a rectangular cuboid base; a front surface; a rear surface; a horizontal axis; a vertical axis; two upper vertical elongate grooves formed on the rear surface and disposed in parallel above the horizontal axis; and two lower vertical elongate grooves formed on the rear surface and disposed in parallel below the horizontal axis; a top sidewall; a bottom sidewall; and two opposing sidewalls, each of the opposing sidewalls extending between the top sidewall and the bottom sidewall; all of the sidewalls extending upwardly and perpendicular to the rectangular cuboid base; a multi-wall polycarbonate rectangular cuboid panel configured for being received in the receptacle, including: a front surface; a rear surface; a horizontal axis; a vertical axis; a top edge; a bottom edge; two opposing side edges, each of the side edges extending between the top edge and the bottom edge; two upper vertical rows including a pair of horizontally oriented slotted apertures, each of the upper vertical rows being disposed in parallel above the horizontal axis a selected distance from one of the opposing side edges; two lower vertical rows including a pair of horizontally oriented slotted apertures, each of the lower vertical rows being disposed in parallel below the horizontal axis a selected distance from one of the opposing side edges; a two-sided adhesive material with removable protective paper thereon, a first side of the adhesive material being disposed on the front surface of the panel with portions of the first side of the adhesive material removed from the area defined by each of the slotted apertures; four buckled straps, each of the straps including a buckle fixed to one end of a strap, a middle portion, and a free end, each of the straps being disposed through a corresponding pair of the slotted apertures, each end of the buckled strap extending from the slotted apertures on the rear surface of the panel, wherein once the free end of the buckled strap is coupled to the buckle, a portion of protective paper in an area defined by and underneath the strap is removed on the front surface, and the strap adheres to a second side of the adhesive material, and wherein upon removal of the remaining protective paper, the second side of the adhesive material adheres the front surface of the panel to the rear surface of the cuboid base, and the middle portions of the straps are received in the vertical grooves of the cuboid base.

According to another aspect of the invention, a method for making a window protector device includes the steps of: providing a polycarbonate receptacle configured to be received in an outermost groove of a double-hung tilt-wash window frame, including: a rectangular cuboid base; a front surface; a rear surface; a horizontal axis; a vertical axis; two upper vertical elongate grooves formed on the rear surface and disposed in parallel above the horizontal axis; and two lower vertical elongate grooves formed on the rear surface and disposed in parallel below the horizontal axis; a top sidewall; a bottom sidewall; and two opposing sidewalls, each of the opposing sidewalls extending between the top sidewall and the bottom sidewall; all of said sidewalls extending upwardly and perpendicular to the rectangular cuboid base; providing a multi-wall polycarbonate rectangular cuboid panel configured for being received in the receptacle, including: a front surface; a rear surface; a horizontal axis; a vertical axis; a top edge; a bottom edge; two opposing side edges, each of the side edges extending between the top edge and the bottom edge; two upper vertical rows comprising a pair of horizontally oriented slotted apertures, each of the upper vertical rows being disposed in parallel above the horizontal axis a selected distance from one of the opposing side edges; two lower vertical rows including a pair of horizontally oriented slotted apertures, each of the lower vertical rows being disposed in parallel below the horizontal axis a selected distance from one of the opposing side edges; providing a two-sided adhesive material with removable protective paper thereon, disposing a first side of the adhesive material onto the front surface of the panel with portions of the adhesive material removed from the area defined by each of the slotted apertures; providing four buckled straps, each of the straps comprising a buckle fixed to one end of a strap, a middle portion, and a free end, each of the straps disposed through a corresponding pair of slotted apertures, each end of the buckled straps extending from the slotted apertures on the rear surface of the panel, wherein, once the free ends of the buckled straps are coupled to the buckles, a portion of protective paper in an area defined by and underneath each of the straps is removed on the front surface, and the straps adhere to a second side of the adhesive material, and wherein upon removal of the remaining protective paper, the second side of the adhesive material adheres the front surface of the panel to the rear surface of the cuboid base, and the middle portions of the straps are received in the vertical grooves of the cuboid base.

BRIEF DESCRIPTION OF THE DRAWINGS

Throughout the drawings, like reference numerals are used to indicate common features of the described devices.

The above-identified drawing figures set forth several preferred embodiments of the invention. The disclosure represents the invention, but is not limited thereby, as it should be understood that numerous other modifications and embodiments may be devised by those skilled in the art which fall within the scope and spirit of the invention as claimed.

DETAILED DESCRIPTION OF THE INVENTION

As used herein, the terms "comprises", "comprising", "includes", "including", "has", "having", or any other variation thereof, are intended to cover non-exclusive inclusions. For example, a process, method, article or apparatus that comprises a list of elements is not necessarily limited to only those elements but may include other elements not expressly listed or inherent to such process, method, article, or apparatus. In addition, unless expressly stated to the contrary, the term "of" refers to an inclusive "or" and not to an exclusive "or". For example, a condition A or B is satisfied by any one of the following: A is true (or present) and B is false (or not present); A is false (or not present) and B is true (or present); and both A and B are true (or present).

The terms "a" or "an" as used herein are to describe elements and components of the invention. This is done for convenience to the reader and to provide a general sense of the invention. The use of these terms in the description herein should be read and understood to include one or at least one. In addition, the singular also includes the plural unless indicated to the contrary. As used in this specification and the appended claims, the term "or" is generally employed in its sense including "and/or" unless the content clearly dictates otherwise.

All numeric values are herein assumed to be modified by the term "about," whether or not explicitly indicated. The term "about" generally refers to a range of numbers that one of skill in the art would consider equivalent to the recited value (i.e., having the same function or result). In any instances, the terms "about" may include numbers that are rounded to the nearest significant figure.

Figure 1:
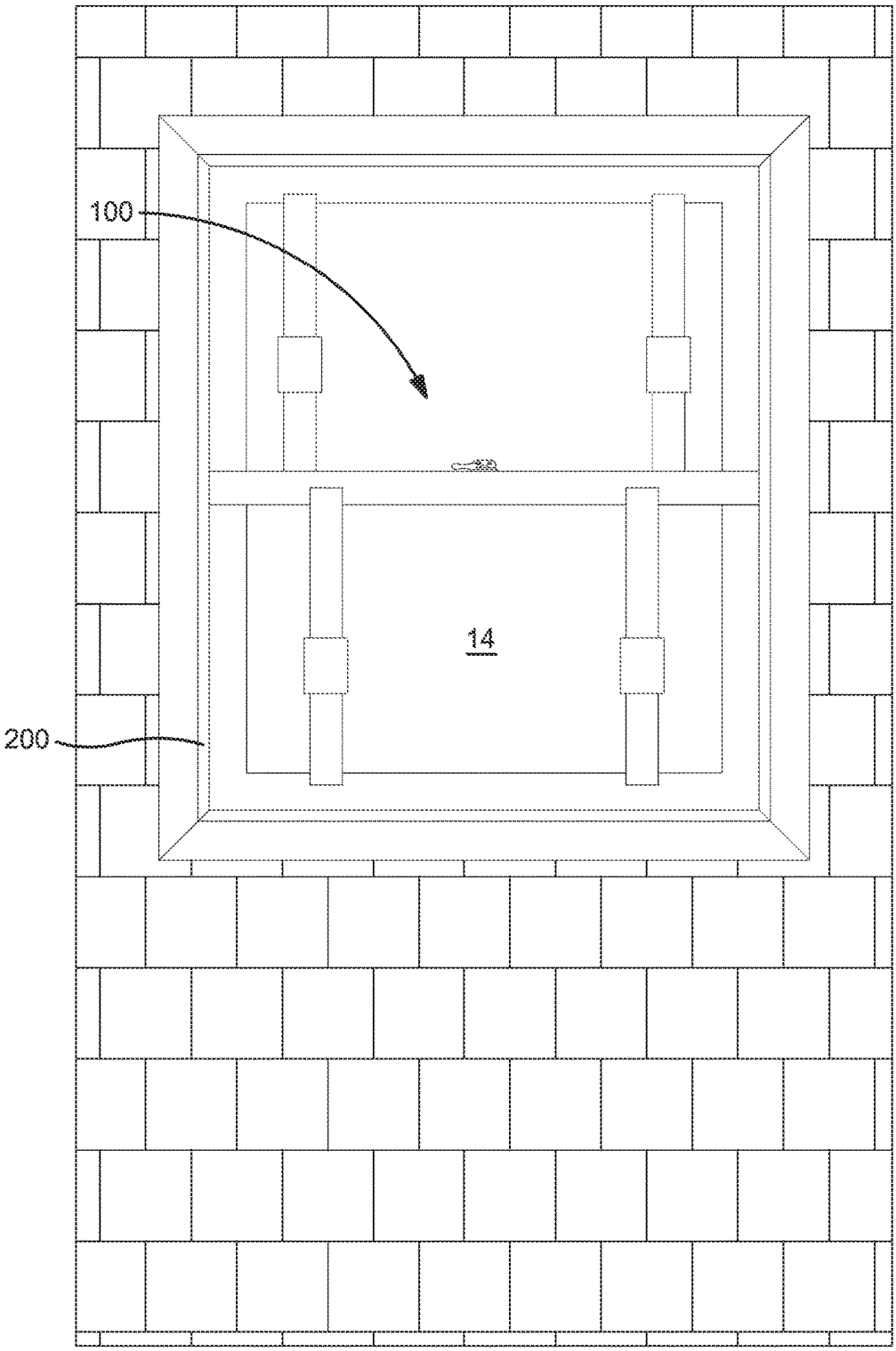
FIG. 1 is a front view illustrating the device disposed in the outermost groove of a double-hung, tilt-wash window frame, as viewed from the outside of a structure, according to an aspect of the invention.
Figure 2:
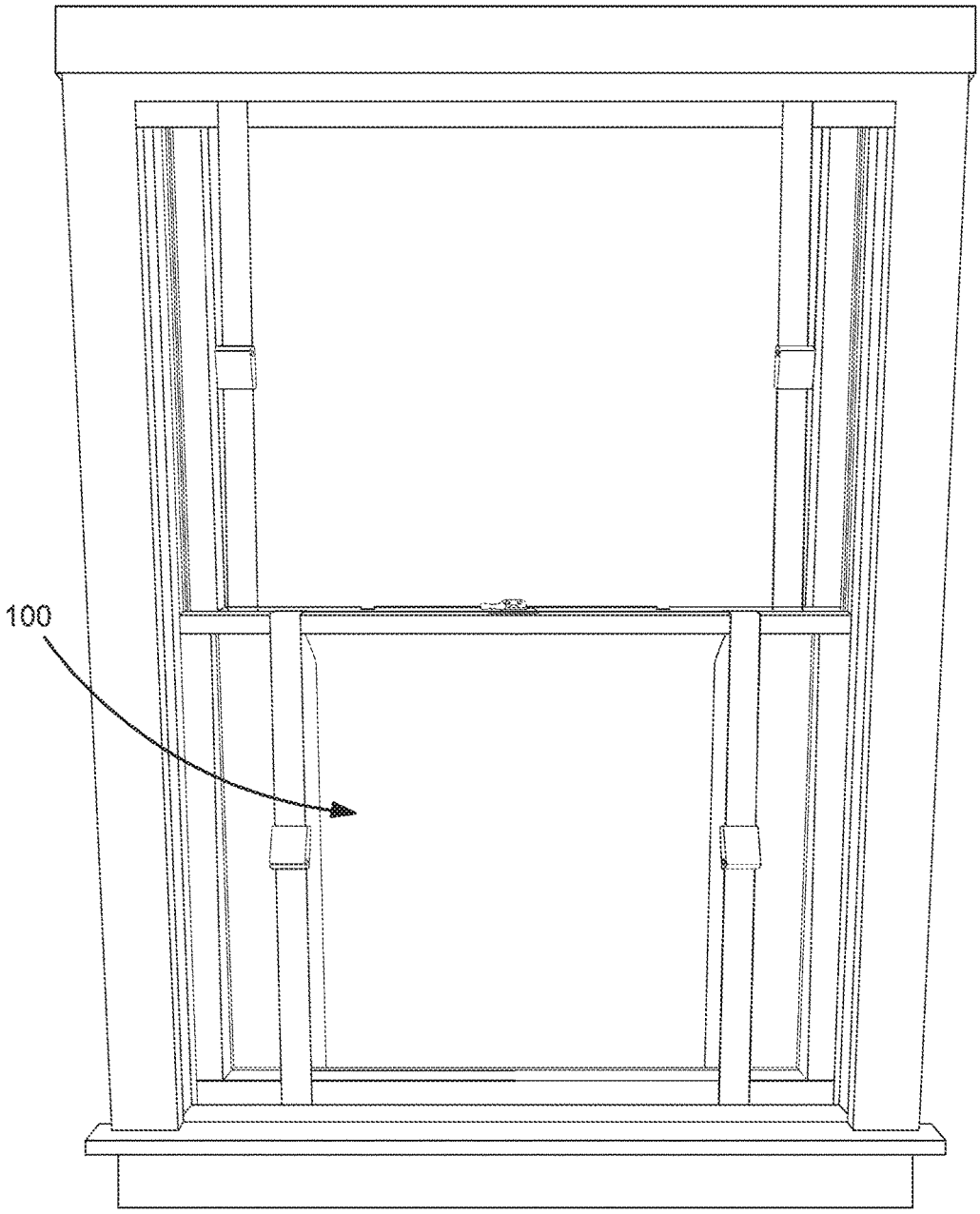
FIG. 2 is a rear elevational view illustrating the device disposed in the outermost groove of a double-hung, tilt-wash window frame, as viewed from the inside of a structure, according to an aspect of the invention.

Referring to FIG. 1, the device 100 is illustrated as being disposed in the outermost groove of a double-hung, tilt-wash window frame, as would be viewed from the outside of a structure, for example, a home or building. Referring to FIG. 2, the device 100 is illustrated as one would view the device 100 from the inside of a structure.

Figure 3:
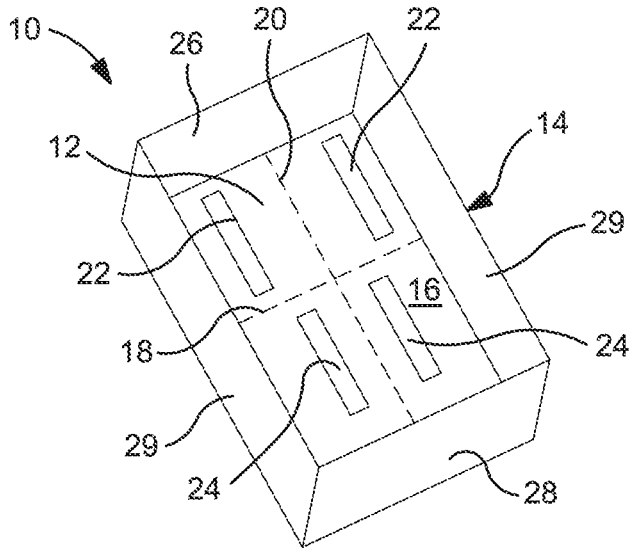
FIG. 3 is a rear elevational view illustrating the receptacle member according to an aspect of the invention.

Referring to FIG. 3, a solid, rigid polycarbonate receptacle 10 configured for being received in an outermost groove of a double-hung, tilt-wash window frame is illustrated. The receptacle 10 includes a rectangular cuboid base 12, a front surface 14 (shown in FIG. 1), a rear surface 16, a horizontal axis 18 and a vertical axis 20. Also illustrated are two upper vertical elongate grooves 22 formed on the rear surface 16 and disposed in parallel above the horizontal axis 18. Two lower vertical elongate grooves 24 are also formed on said rear surface 16 and are disposed in parallel below the horizontal axis 18. Grooves 22 and 24 are not through-holes, but are cut-away portions formed into the rear surface 16 of the cuboid base 12, and are about 1/32" deep. A suitable thickness for the rigid polycarbonate is about 1/8", although other thicknesses may be employed. The polycarbonate is commercially available from multiple manufacturers, is transparent, to allow light to enter a structure, and is ultra-violet (UV) resistant.

Still referring to FIG. 3, the receptacle 10 also includes a top sidewall 26, a bottom sidewall 28, and two opposing sidewalls 29. The opposing sidewalls 29 extend between the top sidewall 26 and bottom sidewall 28. All of the sidewalls 26, 27 and 29 extend upwardly from and are perpendicular to the cuboid base 12.

Figure 4:
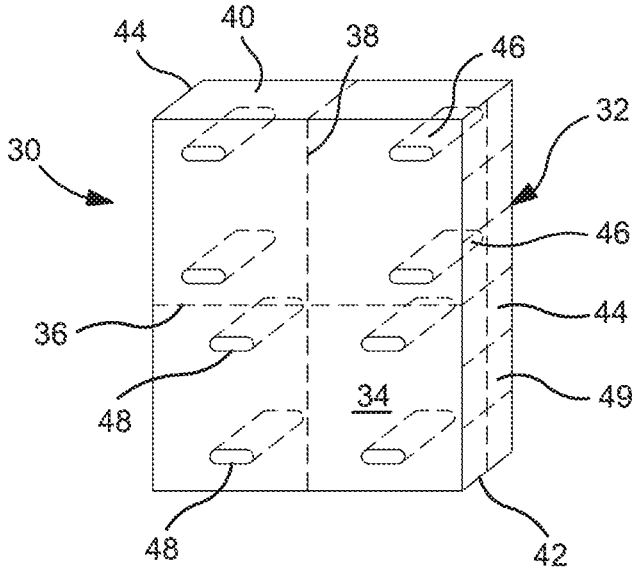
FIG. 4 is a rear elevational view illustrating the cuboid panel configured for being received by the receptacle member of FIG. 3, according to an aspect of the invention.

Referring to FIG. 4, a multi-wall polycarbonate rectangular cuboid panel 30 configured for being received in the receptacle 10 is illustrated. The panel 30 is sized to allow for expansion and contraction when placed within the receptacle 10. The panel 30 includes a front surface 32 (shown in FIG. 5), a rear surface 34, a horizontal axis 36, a vertical axis 38, a top edge 40, a bottom edge 42 and two opposing side edges 44 that extend between the top edge 40 and the bottom edge 42. Also illustrated as being disposed in parallel with respect to the vertical axis 38 are two upper vertical rows that include a pair of horizontally-oriented slotted apertures 46. Each of the upper vertical rows 46 are disposed in parallel above the horizontal axis 36 a selected distance from one of the opposing side edges 44. Two lower vertical rows of slotted apertures 48 are also illustrated as being disposed in parallel with respect to the vertical axis 38, and each row 48 is located below the horizontal axis 36 a selected distance from one of the opposing side edges 44. By way of example, and depending upon the size of the window, the upper vertical rows 46 are approximately 2" from a side edge 44, and the lower vertical rows 48 are approximately 3.5 inches from a side edge 44. The slotted apertures 46 and 48 are approximately 1/8' in height and 1.5" in width to accommodate a strap (as will herein be described). In addition, open air through-channels 49 extend from one side edge 44 to the opposite edge 44. Although the multi-wall polycarbonate illustrated is that of a three-wall design, other multi-wall polycarbonate walls may also be suitable for use.

A suitable thickness for the multi-wall polycarbonate panel 30 is about 5/8", although other thicknesses may be employed. The multi-wall polycarbonate panel 30 is commercially available from multiple manufacturers, and is transparent, as with the solid polycarbonate, to allow light to enter a structure, and is UV resistant. Advantageously, the edges 44 of the multi-wall polycarbonate panel 30 which include open channels 49 are protected from wind, water and dirt by the sidewalls 26, 28, and 29 of the receptacle 10 and provide additional insulation.

Figure 5:
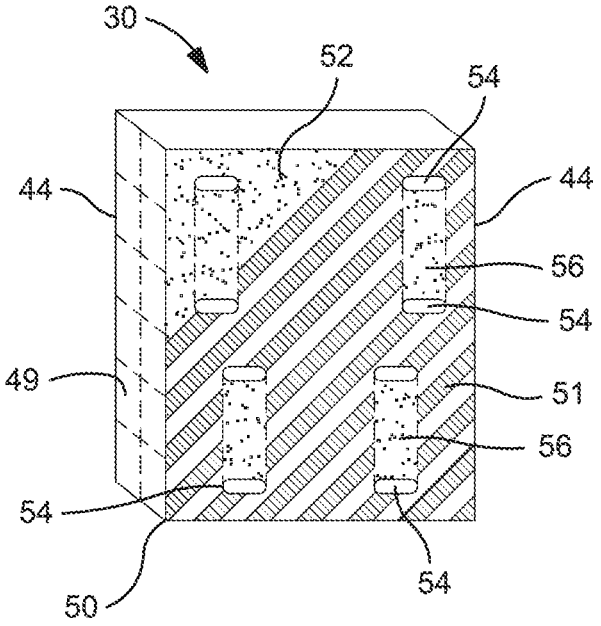
FIG. 5 is a front elevational view illustrating the cuboid panel with an adhesive layer disposed thereon, according to an aspect of the invention.

Referring now to FIG. 5, one side of a two-sided pressure-sensitive adhesive material 50 with protective paper or release sheets 51 disposed on each side thereof, and having one side of the protective paper removed, is disposed on the front surface 32 of the panel 30 with portions of the adhesive material and protective paper 54 removed from the area defined by the slotted apertures 46 and 48 (FIG. 4). Once the portions of adhesive material and protective paper 54 are removed, buckled straps 60 are inserted through the slotted apertures 46 and 48 from the rear surface 34 of the panel 30 and temporarily buckled together (FIG. 6), and the middle portions of the straps 66 are tacked down temporarily with a removable tape on the front surface. Thereupon, the portion of protective paper 56 defined by and located directly beneath the middle portion 66 of the strap is removed, exposing the second side of adhesive material 52, and the middle portions of the straps 66 are adhered to the second side of adhesive material. Thereafter, the remaining portion of protective paper is removed, and the second side of the adhesive material 52 allows the front surface 32 of the panel 30 to become adhered to the rear surface 16 of the receptacle 10. The two-sided adhesive material is commercially available from 3M (product number 468MP—5 mil), although other two-sided adhesive materials may be used.

Figure 6:
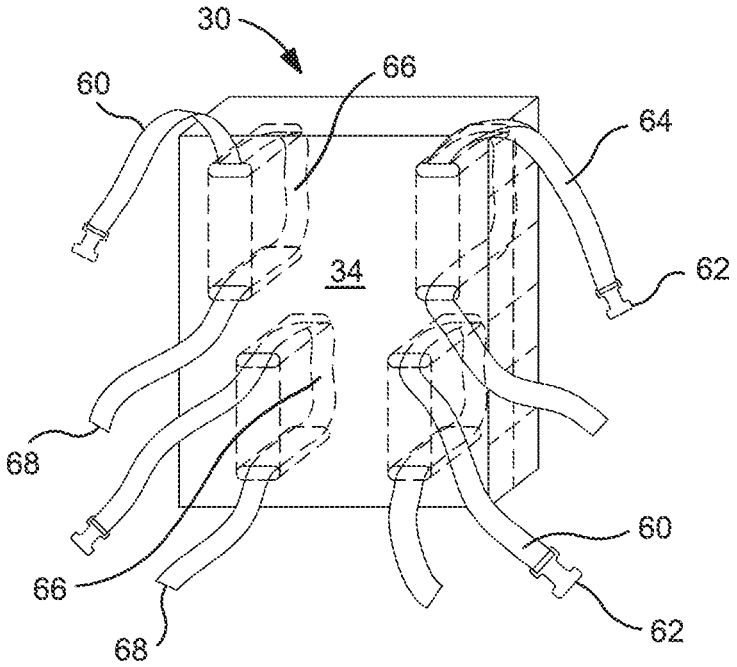
FIG. 6 is a rear elevational view illustrating buckled straps extending through pairs of slotted apertures, according to an aspect of the invention.

Referring now to FIG. 6, cam-buckled straps 60 are illustrated as extending outwardly from the rear surface 34 of the panel 30, having been looped through from the front surface 32 through the corresponding slotted apertures 46 and 48. The buckled straps 60 include a buckle 62 or other suitable fastening device fixed to one end of a strap 64. The buckled straps 60 also include a middle strap portion 66, and a free end 68 that couples with the buckle 62. The straps 64 may have a thickness of 1/32", which thickness corresponds with the elongate grooves 22 and 24 formed in the receptacle 10 (illustrated in FIG. 3). The straps 64 may be formed of polyester, and are commercially available from various manufacturers. The buckles 62 may be formed of plastic. Advantageously, having two buckled straps 60 on the upper sash and the lower sash reduces the potential for breaking the lock (or locks) on a window, as no pressure is exerted on the window locking system when tightening the straps 60 about the respective sashes after installing the device 100.

Once the device 100 is assembled, it is ready to be placed into the outermost groove 200 of a window. The screen is first removed from the groove adjacent the window, the upper sash is lowered, and the lower sash is raised up almost all the way so the protector device 100 may be tilted and maneuvered outside the window frame and placed into the groove that previously held the screen. At this point, a second person takes hold of the upper straps through the opening of the top sash (a foot stool may be needed) to hang in the interior of the home, and the top sash is closed to prevent the device 100 from falling. At this point, the bottom straps are pulled through the opening of the bottom sash and allowed to hang in the interior of the home. Before closing the bottom sash, the top of the bottom sash is tilted so the straps for the upper and lower sashes can be brought in and placed under the corresponding top sash and above the corresponding bottom sash. Thereafter, the bottom sash is tilted back into the window frame and locked into place. Each of the straps are then tightened and buckled together so the device 100 is tightly maintained in the screen tracks. The straps on the top sash should be pulled upward and the straps on the bottom should be pulled downward so there is no pressure exerted on the locking system of the window which prevents potential damage to the window. The buckles 62 of the straps 60 are centrally-located with respect to each sash.

Advantageously, the device 100 allows for installation from the inside of a house or other structure. The device 100 is lightweight (one square foot weighs 1.25 lbs.), is impact and wind resistant, and is easy to install from the inside of a structure, and also without the need for tools, or hardware (including, for example, nails, nuts, bolts screws, hinges, and other fastening devices). In addition, the device 100 has demonstrated no damage after positive and negative uniform load structural testing. For example, the Uniform Load Structural Performance Test ASTM E330-14 conducted resulted in the device 100 being able to withstand 57.6 pounds per square foot (psf) which is the equivalent pressure that would be generated from 150 mile per hour (mph) wind speeds. Testing determined there were no cracks, breakage or disengagement of any member within the panel.

The invention has been described with reference to specific embodiments. One of ordinary skill in the art, however, appreciates that various modifications and changes can be made without departing from the scope of the invention as set forth in the claims. Accordingly, the specification is to be regarded in an illustrative manner, rather than with a restrictive view, and all such modifications are intended to be included within the scope of the invention.

What is claimed is:

1. A window protector device, comprising:

a polycarbonate receptacle configured to be received in an outermost groove of a double-hung tilt-wash window frame, comprising:
- a rectangular cuboid base;
- a front surface;
- a rear surface;
- a horizontal axis;
- a vertical axis;
- two upper vertical elongate grooves formed on said rear surface and disposed in parallel above the horizontal axis; and
- two lower vertical elongate grooves formed on said rear surface and disposed in parallel below the horizontal axis;
- a top sidewall;
- a bottom sidewall; and
- two opposing sidewalls, each of said opposing sidewalls extending between said top sidewall and said bottom sidewall; all of said sidewalls extending upwardly and perpendicular to said rectangular cuboid base;

a multi-wall polycarbonate rectangular cuboid panel configured for being received in said receptacle, comprising:
- a front surface;
- a rear surface;
- a horizontal axis;
- a vertical axis;
- a top edge;
- a bottom edge;
- two opposing side edges, each of said side edges extending between said top edge and said bottom edge;
- two upper vertical rows comprising a pair of horizontally oriented slotted apertures, each of said upper vertical rows being disposed in parallel above said horizontal axis a selected distance from one of said opposing side edges;
- two lower vertical rows comprising a pair of horizontally oriented slotted apertures, each of said lower vertical rows being disposed in parallel below said horizontal axis a selected distance from one of said opposing side edges;
- a two-sided adhesive material with removable protective paper thereon, a first side of said adhesive material being disposed on the front surface of said panel with portions of said first side of said adhesive material removed from the area defined by each of said slotted apertures;
- four buckled straps, each of said straps comprising a buckle fixed to one end of a strap, a middle portion, and a free end, each of said straps being disposed through a corresponding pair of said slotted apertures, each end of said buckled strap extending from said slotted apertures on said rear surface of said panel, wherein once said free end of said buckled strap is coupled to the buckle, a portion of protective paper in an area defined by and underneath said strap on the front surface is removed, and said strap adheres to a second side of said adhesive material, and wherein upon removal of the remaining protective paper, said second side of said adhesive material adheres said front surface of said panel to said rear surface of said cuboid base, and said middle portions of said straps are received in said vertical grooves of said cuboid base.

2. A method for making a window protector device, comprising the steps of:

providing a polycarbonate receptacle configured to be received in an outermost groove of a double-hung tilt-wash window frame, comprising:

a rectangular cuboid base;

a front surface;

a rear surface;

a horizontal axis;

a vertical axis;

two upper vertical elongate grooves formed on said rear surface and disposed in parallel above the horizontal axis; and two lower vertical elongate grooves formed on said rear surface and disposed in parallel below the horizontal axis;

a top sidewall;

a bottom sidewall; and two opposing sidewalls, each of said opposing sidewalls extending between said top sidewall and said bottom sidewall; all of said sidewalls extending upwardly and perpendicular to said rectangular cuboid base;

providing a multi-wall polycarbonate rectangular cuboid panel configured for being received in said receptacle, comprising:

a front surface;

a rear surface;

a horizontal axis;

a vertical axis;

a top edge;

a bottom edge;

two opposing side edges, each of said side edges extending between said top edge and said bottom edge;

two upper vertical rows comprising a pair of horizontally oriented slotted apertures, each of said upper vertical rows being disposed in parallel above said horizontal axis a selected distance from one of said opposing side edges;

two lower vertical rows comprising a pair of horizontally oriented slotted apertures, each of said lower vertical rows being disposed in parallel below said horizontal axis a selected distance from one of said opposing side edges;

providing a two-sided adhesive material with removable protective paper thereon, disposing a first side of said adhesive material onto the front surface of said panel with portions of the adhesive material removed from the area defined by each of said slotted apertures;

providing four buckled straps, each of said straps comprising a buckle fixed to one end of a strap, a middle portion, and a free end, each of said straps disposed through a corresponding pair of slotted apertures, each end of said buckled straps extending from said slotted apertures on said rear surface of said panel, wherein, once said free ends of said buckled straps are coupled to said buckles, a portion of protective paper in an area defined by and underneath each of said straps on the front surface is removed, and said straps adhere to a second side of said adhesive material, and wherein upon removal of the remaining protective paper, said second side of said adhesive material adheres said front surface of said panel to said rear surface of said cuboid base, and said middle portions of said straps are received in said vertical grooves of said cuboid base.

* * * * *